US006232756B1

(12) United States Patent
Kurihara

(10) Patent No.: US 6,232,756 B1
(45) Date of Patent: May 15, 2001

(54) BAND GAP REFERENCE CIRCUIT

(75) Inventor: Kazuo Kurihara, Miyagi (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/538,464

(22) Filed: Mar. 30, 2000

(30) Foreign Application Priority Data

Mar. 31, 1999 (JP) ..... 11-094157

(51) Int. Cl.[7] ..... G05F 3/16
(52) U.S. Cl. ..... 323/313; 327/539
(58) Field of Search ..... 323/311, 312, 323/313, 315; 327/538, 539, 540, 541, 542, 543

(56) References Cited

U.S. PATENT DOCUMENTS 5,168,210 * 12/1992 Thus ..... 323/313
5,339,020 * 8/1994 Siligoni et al. ..... 323/313
5,430,367 * 7/1995 Whitlock et al. ..... 323/313

* cited by examiner

*Primary Examiner*—Peter S. Wong
*Assistant Examiner*—Gary L. Laxton
(74) *Attorney, Agent, or Firm*—Frommer Lawrence & Haug, LLP; William S. Frommer; Darren M. Simon

(57) ABSTRACT

A band gap reference circuit in which a desired constant voltage is obtained without appreciably increasing the number of components. The base-to-emitter voltage of a transistor 22 is equal to the base-to-emitter voltage of a transistor 19, because the current of 2I flows through a parallel connection of two NPNs. If this voltage is Vbe1, the resistance of a resistor 28 is Re, the resistance of the resistors 29, 30 is 2R and the emitter voltage of the transistor 23 is VO', this voltage VO' is given by the following equation:

$$Vo' = 2\ \mathrm{Vbe}\ 1 + 2\ (R/Re) \cdot 1n(n) \cdot Vt$$

such that a voltage twice the voltage Vo is outputted by summing the sum of the base-to-emitter voltages of two transistors to the thermal voltage multiplied by a coefficient proportionate to the number of transistors (two).

3 Claims, 3 Drawing Sheets

BAND GAP REFERENCE CIRCUIT

BACKGROUND OF THE INVENTION

1. Field of the Invention

This invention relates to a bipolar IC employed in a variety of linear circuits. More particularly, it relates to a band gap reference circuit capable of outputting optional voltages of good temperature characteristics by a simplified structure.

2. Description of the Related Art

In general, a bipolar IC is used widely for processing electrical signals of equipment for household and industrial application. As a constant voltage source of the bipolar IC, a band gap reference circuit of good temperature characteristics is used extensively. FIG. 1 shows an example of this band gap reference circuit.

A transistor 101 has its emitter grounded, while having its base connected to its collector, and to the base of a transistor 102. The transistor 102 is a parallel connection of n NPNs and has its emitter grounded via a resistor 109 while having its collector connected to a resistor 111 and to the base of a transistor 103. The transistor 103 has its emitter grounded, while having its collector connected to the collector of the transistor 106 and to the collector of a transistor 107.

A transistor 104 has its emitter connected to the resistor 111 and to a positive input of an operational amplifier 117, while having its collector connected to the base of a transistor 105 and to the base of the transistor 106. The transistor 105 is a parallel connection of n NPNs and has its emitter connected via a resistor 112 to the positive terminal of a power source 118. The transistor 106 has its emitter connected to an emitter of the transistor 107 and a resistor 113. The base of the transistor 107 is connected to the base and the collector of the transistor 108 and grounded via resistor 114. The transistor 108 has its emitter connected to the positive terminal of the power source 118.

The negative input of the operational amplifier 117 is grounded via resistor 115, while being connected to its own output via resistor 116.

The operating principle of this circuit is hereinafter explained. The base current of the transistors is disregarded.

It is assumed that the current flowing through the transistor 101 is I1, with the current flowing through its base-emitter path being Vbe1. It is also assumed that the current flowing through the transistor 102 is I2, with the current flowing through its base-emitter path being Vbe2. If the sum current of these currents I1 and I2 is equal to 2I, the current flowing through the transistor 103 is I, by the current mirror circuit constituted by the transistors 105 and 106 and by the resistors 112 and 13. It is also assumed that the voltage across the base and the emitter of the transistor 103 is Vbe3, the resistance value of the resistor 109 is Re, the resistance value of each of the resistors 110 and 111 is R and the emitter voltage of the transistor 104 is Vo.

The voltage Vo then is represented by the following equation (1-1), with the current I being represented by the following equation (1-2):

$$Vo=\mathrm{Vbe}\mathbf{1}+R\cdot \mathrm{I}\mathbf{1}=\mathrm{Vbe}\mathbf{3}+R\cdot \mathbf{12} \tag{1-1}$$

$$2I=\mathrm{I}\mathbf{1}+\mathrm{I}\mathbf{2} \tag{1-2}$$

By the Schokley's diode equation, Vbe1 and Vbe3 are represented by the following equations (1-3) and (1-4):

$$\mathrm{Vbe}\mathbf{1}=Vt\cdot 1\mathrm{n}(\mathrm{I}\mathbf{1}/Is) \tag{1-3}$$

$$\mathrm{Vbe}\mathbf{3}=Vt\cdot 1\mathrm{n}(I/Is) \tag{1-4}$$

where Vt is a thermal voltage and Is is a proportionality constant.

Substituting the equations (1-2), (1-3) and (14) into the equation (1-1) and recomputing, the following equation (1-5):

$$\mathrm{I}=\mathrm{I}\mathbf{1}=\mathrm{I}\mathbf{2} \tag{1-5}$$

is obtained, from which it is seen that equal currents flow trough the transistors 101, 102 and 103.

From this equation, the voltages Vbe1 and Vbe2 are represented by the following equation (1-6):

$$\mathrm{Vbe}\mathbf{1}=\mathrm{Vbe}\mathbf{2}+Re\cdot I \tag{1-6}$$

Also, from the Schokley's diode equation, Vbe2 is represented by the following equation (1-7):

$$\mathrm{Vbe}\mathbf{2}=Vt\cdot 1n\{I/(n\cdot Is)\} \tag{1-7}$$

Substituting the equations (1-3), (1-5) and (1-7) into the equation (1-6) and recomputing, the following equation (1-8) representing the relationship between the current I flowing through each of the transistors 101 to 103 and other constants:

$$I=(1n(n)/Re)\cdot Vt \tag{1-8}$$

Substituting the equations (1-3), (1-5) and (1-8) into the equation (1-1), and computing, the following equation (1-9) representing the voltage Vo:

$$Vo=\mathrm{Vbe}\mathbf{1}+(R/Re)\cdot 1n(n)\cdot Vt \tag{1-9}$$

is obtained.

The condition under which this voltage Vo is not temperature-dependent is that the voltage Vo differentiated with respect to temperature is equal to 0. That is, it suffices if the following equation (1-10)

$$dVo/dT=(\mathrm{dVbe}\mathbf{1}/dT)+(R/Re)\cdot 1n(n)\cdot k/q=0 \tag{1-10}$$

where k is the Boltzmann's constant and q is an electron charge, holds.

It is well known that the voltage Vbe across the base and the emitter of a silicon transistor is decreased by 1.7 mV with rise in temperature by 1° C. Therefore, the voltage Vo is not temperature-dependent if the respective constants are determined so that the following equation (1-11):

$$(R/Re)\cdot 1n(n)=-(q/k)\cdot(\mathrm{dVb}\mathbf{1}/dT)=19.7 \tag{1-11}$$

It is also well-known that the voltage Vbe across the base and the emitter of the silicon transistor is approximately 0.7 V in the vicinity of room temperature. Substituting this value and the value of the equation (1-11) into the above equation (19) and computing, the voltage Vo with good temperature characteristics, obtained by the band gap reference circuit, is 1.21 V.

Stated differently, the voltage Vo produced when the negative temperature characteristics of the voltage Vbe is cancelled with positive temperature characteristics of the thermal voltage Vt is 1.21 V.

The operation of other constituent portions of the band gap reference circuit is now explained briefly.

The transistor 104 operates as a part of a negative feedback circuit for stabilizing the voltage Vo. That is, if the voltage Vo is about to be increased, the base voltage of the transistor 103 is increased, with the base voltage of the transistor 104 then being about to be decreased. The result is that the voltage Vo is a stable voltage.

The transistors 107, 108 and the resistor 114 represent a startup circuit for power on of the above-mentioned band gap reference circuit. During the normal operation, the transistor 107 is turned off For changing the above-mentioned voltage Vo to an optional magnitude, voltage conversion through a DC amplifier is required.

Such a DC amplifier may be constituted by an operational amplifier 117, a resistor 115 and a resistor 116. If the resistance value of the resistor 115 is Ri and that of the resistor 116 is Ro, the DC amplification ratio is Ro/Ri. Therefore, an optional constant voltage Vo' is given by the following equation (1-12):

$$Vo'=(Ro/Ri)\cdot Vo \quad (1\text{-}12)$$

However, since the DC amplifier needs to be constituted within the bipolar IC, the number of circuit elements is increased such that the voltage Vo is worsened in precision due to variations in the resistance ratio Ro/Ri.

That is, the constant voltage source employing the conventional band gap reference circuit suffers a problem that the number of elements is increased or precision is worsened by the resistance ratio such that a desired voltage cannot be obtained accurately.

SUMMARY OF THE INVENTION

It is therefore an object of the present invention to provide a band gap reference circuit which enables a desired constant voltage to be realized to high precision without appreciably increasing the number of elements.

In one aspect, the present invention provides a band gap reference circuit wherein base-to-emitter voltages of a plurality of transistors summed together are summed to a thermal voltage multiplied by a coefficient proportionate to the number of transistors to output a constant voltage. That is, the sum of base-to-emitter voltages of a plurality of transistors exhibits negative temperature characteristics, whilst the thermal voltage multiplied by a coefficient proportionate to the number of transistors has positive temperature characteristics, so that, by summing them together, a constant voltage circuit cane provided which has good temperature characteristics. Moreover, a desired voltage can be outputted by selecting the number of the transistors. That is, with the present band gap reference circuit in which the base-to-emitter voltages of a plurality of transistors summed together are summed to a thermal voltage multiplied by a coefficient proportionate to the number of transistors to output a constant voltage, a constant voltage of high stability and precision can be provided without increasing the number of components or providing an amplifier.

In another aspect, the present invention provides band gap reference circuit including a plurality of transistors each connected to one or more resistors in which a power source voltage is divided by the base-to-emitter voltage of each transistor and the resistance voltage of each resistor to output a constant voltage. A pre-set constant voltage may be outputted which has good temperature characteristics and high precision by setting the number of the transistors and the resistance values of the resistors to pre-set values, so that a constant voltage of high stability and precision can be provided without increasing the number of components or providing an amplifier.

DESCRIPTION OF THE PREFERRED EMBODIMENTS

Figure 1:
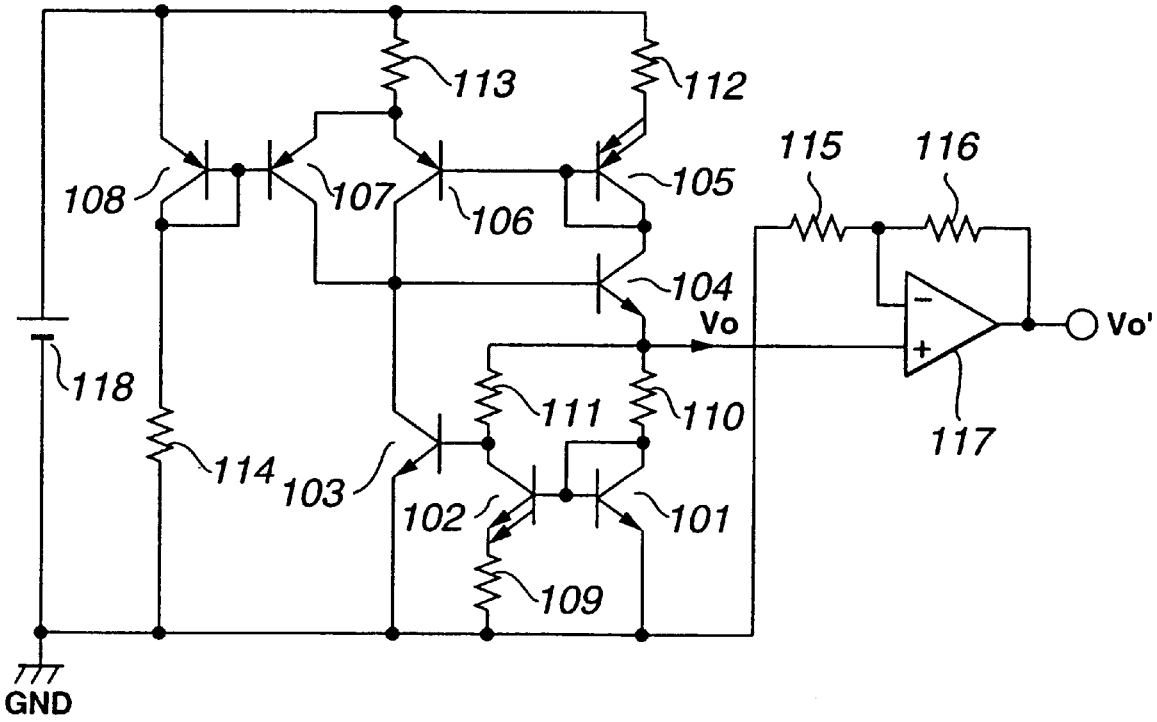
FIG.1 (PRIOR ART)
FIG. 1 is a circuit diagram showing an illustrative structure of a conventional band gap reference circuit.

Referring to the drawings, preferred embodiments of according to the present invention will be explained in detail. Meanwhile, the present invention is not limited to this illustrative structure and may be appropriately modified without departing the scope of the invention.

Figure 2:
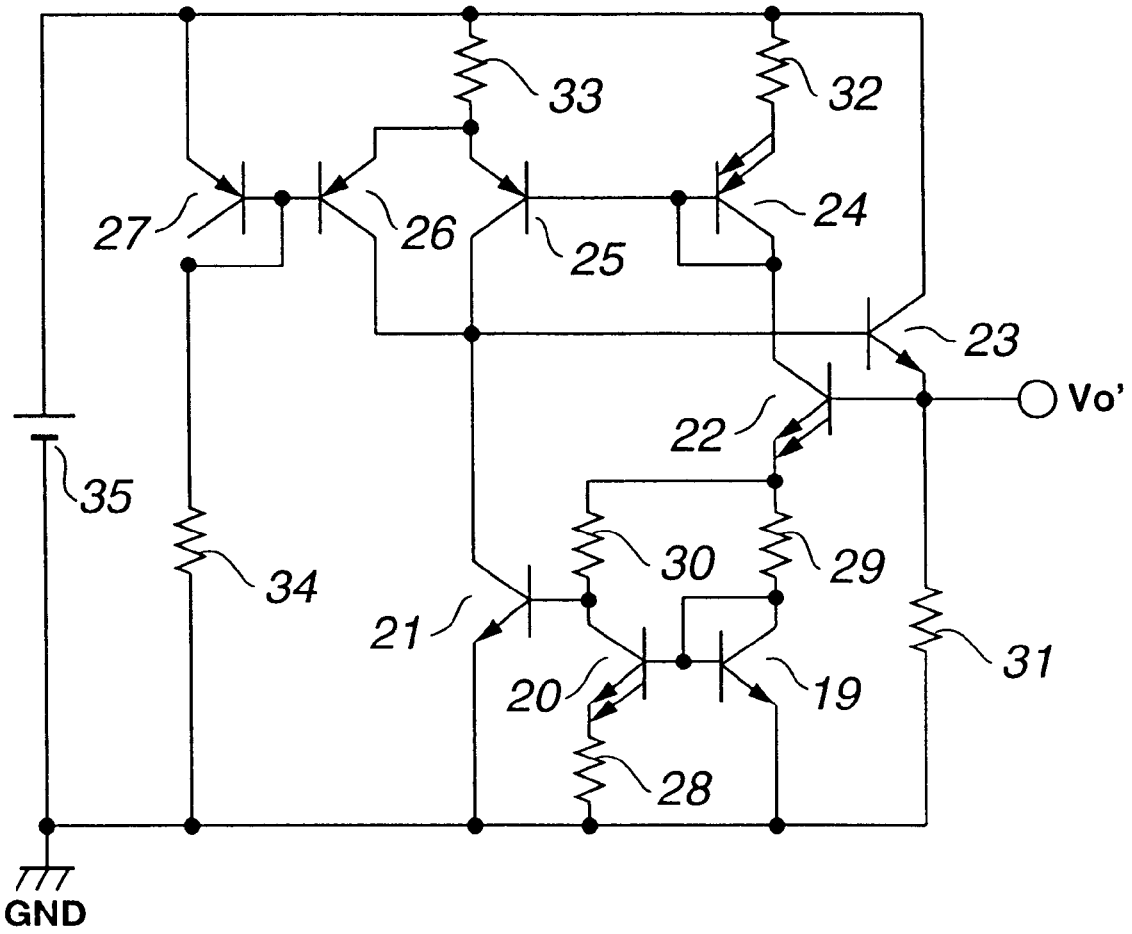
FIG. 2 is a circuit diagram an illustrative structure of a band gap reference circuit according to the present invention.

The present invention is applied to a band gap reference circuit configured as shown for example in FIG. 2.

In the band gap reference circuit, shown in FIG. 2, a transistor 19 has its emitter grounded, while having its base connected to its collector, a resistor 29 and to the base of a transistor 20. The transistor 20 is a parallel connection of n NPNs and has its emitter grounded via a resistor 28 while having its collector connected to a resistor 30 and to the base of a transistor 21. The transistor 21 has its emitter grounded, while having its collector connected to the collector of the transistor 23, to the collector of the transistor 25 and to the collector of a transistor 26. The transistor 23 has its emitter connected to a resistor 31 and to the base of a transistor 22, while having its collector connected to a positive terminal of a power source 35.

The transistor 22 is a parallel connection of n NPNs and has its emitter connected to resistors 29, 30, while having its collector to the base and the collector of the transistor 24 and to the base of the transistor 25. The transistor 24 is a parallel connection of two PNPs and has its emitter connected via resistor 32 to the positive terminal of the power source 35. The transistor 25 has its emitter connected through the emitter of the transistor 26 and a resistor 33 to the positive terminal of the power source 35. The base of the transistor 26 is connected to the base and the collector of the transistor 27, while being grounded via resistor 34. The emitter of the transistor 27 is connected to the positive terminal of the power source 35.

The operating principle of the band gap reference circuit is hereinafter explained. Again, the base current of the transistors is disregarded.

The difference of the present band gap reference circuit from the band gap reference circuit explained in connection with the related art resides in addition of the transistor 22 and the resistor 31.

The transistor 23 and the resistor 31 operate as a portion of a negative feedback circuit for stabilizing the voltage Vo, while also operating as an emitter follower circuit for outputting the voltage Vo' at a low impedance.

The currents flowing through the transistors 19 to 21 are equal as explained above. This current I is represented by the above-mentioned equation (1-8).

Since the current of 2I flows through a parallel connection of two NPNs, the voltge across the base and the emitter of the transistor 22 is equal to the voltage across the base and the emitter of the transistor 19. This voltage is Vbe1. If the resistance of the resistor 28 is Re, the resistance value of the resistors 29, 30 is 2R and the emitter voltage of the transistor 23 is Vo', this voltage Vo' is represented by the following equation (2-1):

$$Vo'=2\mathrm{Vbe}1+2RI=2\mathrm{Vbe}1+2(R/Re)\cdot 1n(n)\cdot Vt \quad (2\text{-}1)$$

If this voltage Vo' is compared to the above equation (1-9), it is seen that the voltage Vo' is twice as large as the voltage Vo. That is, the band gap reference circuit sums the sum of base-to-emitter voltages of two transistors to a thermal voltage multiplied by a coefficient proportionate to the number of transistors (two) to output a voltage equal to twice the voltage Vo. Also, if the respective constants are determined so that the above equation (1-11) holds, the band gap reference circuit is able to output a constant voltage (Vo') of high precision not dependent on the temperature.

Another embodiment of the band gap reference circuit according to the present invention is hereinafter explained with reference to FIG.3. In the following description, parts or components which are the same as those of the first embodiment shown in FIG. 2 are depicted by the same reference symbols and are not explained specifically.

Figure 3:
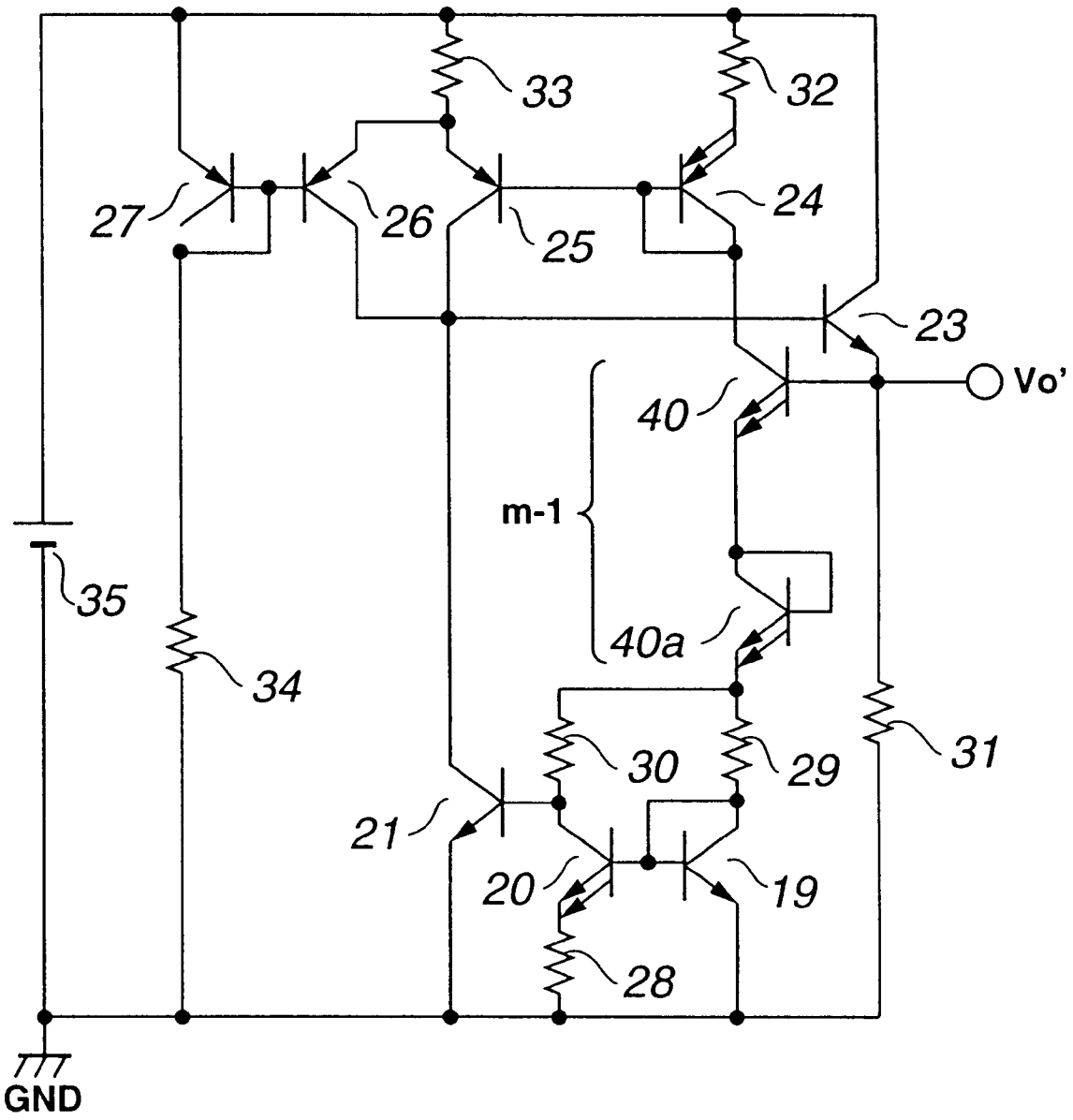
FIG. 3 is a circuit diagram an illustrative structure of another band gap reference circuit according to the present invention.

The band gap reference circuit, shown in FIG. 3, includes (m−1) transistors 40*a*, . . . , 40*b*, in place of the transistor 22 shown in FIG. 2. Moreover, the resistance values of the resistors 29 and 30 are each mR. Thus, the following equation (2-2):

$$Vo'=m\mathrm{Vbe}\mathbf{1}+m(R/Re)\cdot 1n(n)\cdot Vt \qquad (2\text{-}2)$$

That is, a voltage equal to m times as large as the voltage Vo may be outputted by summing the sum of the base-to-emitter voltages of m transistors to the thermal voltage multiplied by a coefficient proportionate to the number of transistors. Stated differently, the desired constant voltage may be outputted by setting the number of the transistors and the resistance values to pre-set values.

What is claimed is:

1. A band gap reference circuit for providing a constant output voltage and having a temperature independent thermal voltage; the thermal voltage being predetermined by a circuit of transistors and resistors operating across a voltage source; wherein the improvement comprises:

a plurality of parallel connection transistors connected in series, said plurality of parallel connection transistors being connected to said circuit such that said constant output voltage is based on the sum of the base-to-emitter voltages across said plurality of parallel connection transistors summed together with the thermal voltage multiplied by a coefficient proportionate to the number of said parallel connection transistors that are connected in series.

2. The band gap reference circuit according to claim 1, further comprising negative feedback means connected to said circuit and having a resistor connected in series to a transistor for performing negative feedback to stabilize said constant output voltage.

3. The band gap reference circuit according to claim 2, wherein said negative feedback means also operates as an emitter follower circuit for outputting said constant output voltage at a low impedance.

* * * * *